US012673366B2

(12) United States Patent
Nakaseko et al.

(10) Patent No.: US 12,673,366 B2
(45) Date of Patent: Jul. 7, 2026

(54) METHOD FOR PRODUCING WATER-ATOMIZED METAL POWDER

(71) Applicant: JFE Steel Corporation, Tokyo (JP)

(72) Inventors: Makoto Nakaseko, Tokyo (JP); Shigeru Unami, Tokyo (JP); Takuya Takashita, Tokyo (JP); Naoki Yamamoto, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 459 days.

(21) Appl. No.: 18/034,773

(22) PCT Filed: Aug. 26, 2021

(86) PCT No.: PCT/JP2021/031264
§ 371 (c)(1),
(2) Date: May 1, 2023

(87) PCT Pub. No.: WO2022/107411
PCT Pub. Date: May 27, 2022

(65) Prior Publication Data

US 2024/0001441 A1 Jan. 4, 2024

(30) Foreign Application Priority Data

Nov. 18, 2020 (JP) ..... 2020-191302

(51) Int. Cl.
*B22F 9/08* (2006.01)

(52) U.S. Cl.
CPC ..... *B22F 9/082* (2013.01); *B22F 2009/0872* (2013.01); *B22F 2009/088* (2013.01); *B22F 2304/10* (2013.01)

(58) Field of Classification Search
CPC ..... B22F 2999/00; C22C 33/0278; C22C 2200/02
See application file for complete search history.

(56) References Cited

U.S. PATENT DOCUMENTS

2010/0139814 A1 6/2010 Makino
2011/0265915 A1 11/2011 Tsuchiya et al.
(Continued)

FOREIGN PATENT DOCUMENTS

CA 2463125 C 11/2010
CA 3110028 A1 * 4/2020
(Continued)

OTHER PUBLICATIONS

English translation of JP 2004156134 (originally published Jun. 3, 2004), obtained from PE2E search.*
(Continued)

*Primary Examiner* — David C Mellon
(74) *Attorney, Agent, or Firm* — Buchanan Ingersoll & Rooney PC

(57) ABSTRACT

A method for producing water-atomized metal powder by dividing a molten metal stream, which is falling in a vertical direction, by spraying cooling water that impinges on the molten metal stream includes a step of spraying the cooling water at a spray pressure of 10 MPa or more and a spread angle in a range of 5° to 30° from each of three or more cooling water discharge ports arranged remote from the falling molten metal stream. The droplet diameter of the cooling water: 100 μm or less, the convergence angle: 5° to 10°, and the water/molten steel ratio: 50 or more.

1 Claim, 4 Drawing Sheets

(56) References Cited

U.S. PATENT DOCUMENTS

| | | | | |
|---|---|---|---|---|
| 2014/0240077 | A1* | 8/2014 | Otsuka | H01F 3/08 336/233 |
| 2018/0073117 | A1 | 3/2018 | Urata et al. | |
| 2020/0001369 | A1* | 1/2020 | Nakaseko | H01F 1/15341 |

FOREIGN PATENT DOCUMENTS

| | | | | |
|---|---|---|---|---|
| CN | 2398039 | Y | | 9/2000 |
| EP | 3838451 | A1 | | 6/2021 |
| JP | 2710938 | B2 | | 2/1998 |
| JP | 2001064704 | A | | 3/2001 |
| JP | 2004156134 | A | * | 6/2004 |
| JP | 2008231533 | A | | 10/2008 |
| JP | 2008231534 | A | | 10/2008 |
| JP | 4288687 | B2 | | 7/2009 |
| JP | 4310480 | B2 | | 8/2009 |
| JP | 4815014 | B2 | | 11/2011 |
| JP | 2012111993 | A | | 6/2012 |
| JP | 2016141817 | A | | 8/2016 |
| JP | 2017031461 | A | | 2/2017 |
| JP | 2018115363 | A | | 7/2018 |
| JP | 6372442 | B2 | | 8/2018 |
| JP | 2020105593 | A | | 7/2020 |
| WO | 2010084900 | A1 | | 7/2010 |

OTHER PUBLICATIONS

Anonymous, "WPPD Method", Journal of the Crystallographic Society of Japan, vol. 30, No. 4, 1988, 10 pages.

Makino et al., "Soft magnetic FeSiBPCu heteroamorphous alloys with high Fe content", Journal of Applied Physics, 105, 013922, 2009, 4 pages.

Makino et al., "The Trend and the Prospects of Nanocrystalline Soft Magnetic Materials", Materia Japan, vol. 41, No. 6, 2002, 12 pages.

International Search Report and Written Opinion for International Application No. PCT/JP2021/031264, dated Sep. 21, 2021, 5 pages.

Zalkind et al., "Superheated Water Atomization: Some New Aspects of Control and Determining Disperse Characteristics of Atomization Plume in Micron and Submicron Ranges of Droplet Size," Journal of Physics: Conference Series, Nov. 10, 2017, vol. 891, 11 pages, XP093088189, Retrieved from the Internet: https://iopscience.iop.org/article/10.1088/1742-6596/891/1/012011/pdf [retrieved on Oct. 6, 2023].

Extended European Search Report for European Application No. 21894286.0, dated Oct. 13, 2023, 12 pages.

Canadian Examination Report for Canadian Application No. 3,198,070, dated May 8, 2024. (4 pages).

Jiao et al., "Influence of Apex Angle and Nozzle Design on Energy and Momentum Transfer During the Water Atomization Process", Conference: Powdermet, Jun. 2017, Las Vegas. (11 pages).

Office Action issued Jul. 2, 2025, by the Canadian Intellectual Property Office in corresponding Canadian Patent Application No. 3,198,070. (4 pages).

Office Action (Request for the Submission of an Opinion) issued Dec. 31, 2025, by the Korean Intellectual Property Office in corresponding Korean Patent Application No. 10-2023-7015236 and an English translation with the Concise Statement of Relevance of the Office Action. (12 pages).

* cited by examiner

METHOD FOR PRODUCING WATER-ATOMIZED METAL POWDER

CROSS REFERENCE TO RELATED APPLICATIONS

This is the U.S. National Phase application of PCT/JP2021/031264, filed Aug. 26, 2021, which claims priority to Japanese Patent Application No. 2020-191302, filed Nov. 18, 2020, the disclosures of these applications being incorporated herein by reference in their entireties for all purposes.

FIELD OF THE INVENTION

The present invention relates to a method for producing water-atomized metal powder. The present invention is particularly suitable as a method for producing water-atomized metal powder such as a soft magnetic metal powder having a total Fe, Ni, and Co content of 76.0 at % or more and 86.0 at % or less in atomic percent, or iron-based powder for 3D printers.

BACKGROUND OF THE INVENTION

With booming production of hybrid vehicles (HVs), electric vehicles (EVs), and fuel cell vehicles (FCVs), reactors and motor cores used in these vehicles are expected to meet the demand for lower iron loss, higher efficiency, and further size reduction.

Such reactors and motor cores have been produced by stacking thinned electrical steel sheets. Recently, motor cores produced by metal powder compaction that offers a high degree of freedom in shape design have attracted much attention.

To lower the iron loss of reactors and motor cores, amorphization of metal powder to be used is considered to be effective. Furthermore, to be compatible with higher frequencies, the particle size of the powder needs to be reduced.

Furthermore, in order to reduce the size and weight and increase the output of reactors and motors, the magnetic flux density of the metal powder needs to be increased. To do this, it is important to increase the concentration of Fe-group elements possibly including Ni and Co (increase the total content of iron-group components), and there is a growing need for amorphous soft magnetic metal powder having an Fe-group element concentration of 76.0 at % or more in atomic percent.

In addition, when atomized metal powder is used as the metal powder, compacted into reactors and motor cores, and used, low core loss is also important for low loss and high efficiency. To achieve this, it is important that the amorphous proportion of the atomized metal powder be high, and the shape of the atomized metal powder is frequently influential. In other words, there is a tendency that the more spherical the shape of the atomized metal powder, the lower the core loss. Furthermore, the spherical shape and the apparent density are closely related, and the powder becomes increasingly spherical as the apparent density increases. In recent years, atomized metal powder is required to achieve an apparent density of 3.5 g/cm$^3$ or more for powder with a small particle diameter.

In addition, as the frequency of the motors and reactors becomes higher, the demand for fine metal powder having an average particle diameter ($D_{50}$) of less than 50 μm has grown.

In recent years, metal powder for 3D printers has drawn much attention as the metal powder of the usage other than rectors and motor cores. Metal powder used in 3D printers is required to be fed smoothly, and the powder particles preferably have a circularity of 0.90 or more.

In view of the above, the following four features are needed as the properties of water-atomized metal powder used in reactors and motor cores.

1) For size reduction and higher performance of motors, the Fe-group element concentration is to be increased (increasing the total Fe-group element content).
2) For low loss and high efficiency, the metal powder is to be highly amorphous and have a high apparent density and a high circularity.

Moreover, the following is also needed due to the growing demand for atomized metal powder against a backdrop of booming production of HVs, EVs, and FCVs.

3) Low cost and high productivity.
4) The metal powder is to have an average particle diameter ($D_{50}$) of less than 50 μm to comply with higher frequencies. Furthermore, atomized metal powder for 3D printers (molding) is also required to satisfy 2) and 3) and preferably further satisfies requirements 1) and 4).

PATENT LITERATURE

PTL 1: Japanese Unexamined Patent Application Publication No. 2001-64704

PTL 2: Japanese Unexamined Patent Application Publication No. 2012-111993

SUMMARY OF THE INVENTION

As a measure to perform amorphization and shape control of metal powder by an atomization process, a method described in Patent Literature 1 has been proposed.

In Patent Literature 1, the molten metal stream is divided by gas jets at a jet pressure of 15 to 70 kg/cm$^2$ and is allowed to fall and disperse over a distance of 10 mm or more and 200 mm or less so that the molten metal stream enters the water stream at an incident angle of 30° to 90° and form metal powder. At an incident angle less than 30°, amorphous powder is not obtained, and, at an incident angle more than 90°, poorly shaped powder particles with a low circularity, such as flat ellipsoids, are observed.

A water atomization process and a gas atomization process are available as the method for dividing a molten metal stream by an atomization method. A water atomization process is a process of obtaining metal powder by spraying cooling water toward a molten metal stream to divide molten steel, whereas a gas atomization process is a process of jetting inert gas toward a molten metal stream. Patent Literature 1 discloses a gas atomization process in which a molten metal stream is first divided by gas.

In a water atomization process, atomized metal powder is obtained by dividing a stream of molten steel by water jets emitted from nozzles or the like to form powdery metal (metal powder) and simultaneously cooling the metal powder with the water jets. Meanwhile, a gas atomization process uses inert gas ejected from nozzles. The gas atomization process has low ability to cool the molten steel and thus sometimes uses separate equipment for cooling after atomization.

For producing metal powder, a water atomization process, which only uses water, offers higher production capability and lower costs than a gas atomization process. However, metal powder produced by a water atomization process has irregular particle shapes. In particular, when division and cooling are simultaneously performed to obtain amorphous metal powder, the molten steel solidifies as divided and thus the apparent density is less than 3.5 g/cm$^3$.

Meanwhile, a gas atomization process needs to use a large amount of inert gas and is inferior, to a water atomization process, in ability to divide molten steel during atomization. However, metal powder produced by a gas atomization process tends to have particle shapes closer to a sphere and a higher apparent density than those prepared by a water atomization process since the time from division to cooling is longer than that in the water atomization process and thus cooling starts after molten steel has assumed a spherical shape due to surface tension.

The technique described in Patent Literature 1 makes metal powder spherical in shape and amorphous simultaneously by adjusting the water jet angle (incident angle) during cooling after gas atomization. However, as discussed above, the gas atomization process has problems of low productivity and high production costs due to the use of a large amount of inert gas. Furthermore, the metal powder produced by the gas atomization process generally tends to have an average particle diameter ($D_{50}$) as large as 50 μm or more since the division energy during gas atomization is smaller than that in water atomization.

Regarding this point, Patent Literature 2 discloses atomizing molten steel into fine spherical particles by arranging spray nozzles to face obliquely downward so that sprays assume a V configuration, and then allowing molten steel to fall toward the center portion where the sprays meet. According to the technique described in Patent Literature 2, fine-particle metal powder is obtained by employing a water atomization process where the spray nozzles are arranged to form a V configuration and by allowing molten steel to fall toward the crossing. This is a preferable means for obtaining fine-particle metal powder; however, since water is dispersed, some of water does not at all contribute to dividing or cooling of the molten steel. Thus, this method is not suitable for improving the cooling performance. This also makes amorphization difficult.

Aspects of the present invention have been made to resolve the above-mentioned problems, and an object thereof is to provide a method for producing water-atomized metal powder by employing a water atomization process, with which metal powder that has an average particle diameter of less than 50 μm, a high amorphous proportion, a high apparent density, a high circularity, and an Fe-group concentration (total Fe-group component content) of 76.0 at % or more is obtained.

Here, the Fe-group concentration refers to the total Fe, Ni, and Co content.

Moreover, the high amorphous proportion means that the amorphous proportion is 90% or higher, the high apparent density means that the apparent density is 3.5 g/cm$^3$ or more, and the high circularity means that the circularity is 0.90 or more.

The inventors of the present invention have conducted extensive studies to address the problems described above. Typically, in the water atomization process, nozzle tips are arranged face down on a circumference at an installation angle (β) so that cooling water converges at the site where the molten steel makes a vertical fall. The angle formed between the vertically falling molten steel and the direction in which the cooling water is sprayed from the nozzle tip is referred to as a convergence angle (α) where the thickness or bulge of the spray is ignored. The convergence angle is one half of the installation angle ($\alpha=\beta/2$). The nozzle tips are attached to a nozzle header. Typically, nozzle tips that spray water in straight lines are used as the nozzle tips; however, as illustrated in FIG. 3, the inventors of the present invention have found that it is effective to use flat spray nozzles that generate sprays spreading in a fan shape. In particular, the inventors have found that it is effective to use spray nozzles with which water sprayed from the discharge ports spread at 5° to 30°.

Furthermore, such spray nozzles are arranged such that the discharge ports are arranged on a circumference and facing downward, and the convergence angle is set to 5° to 10°. Furthermore, it has been found that the aforementioned problems can be resolved by adjusting the ratio of the cooling water to the molten steel, water/molten steel ratio, to 50 or more.

Specifically, aspects of the present invention include a method described in [1] below.

[1] A method for producing water-atomized metal powder by dividing a molten metal stream, which is falling in a vertical direction, by spraying cooling water that impinges on the molten metal stream, the method including:

a step of spraying the cooling water at a spray pressure of 10 MPa or more and a spread angle in a range of 5° to 30° from each of three or more cooling water discharge ports arranged remote from the falling molten metal stream, in which a droplet diameter of the cooling water discharged toward the molten metal stream is 100 μm or less in Sauter mean, a trajectory of the cooling water discharged toward the molten metal stream and a trajectory of the molten metal stream form a convergence angle in a range of 5° to 10°, a water/molten steel ratio (F/M) of an amount F (kg/min) of the cooling water discharged toward the molten metal stream to an amount M (kg/min) of the falling molten metal stream is 50 or more, and the metal powder has a total Fe, Ni, and Co content of 76.0 at % or more and 86.0 at % or less in atomic percent, and an average particle diameter of less than 50 μm, an apparent density of 3.5 g/cm$^3$ or more, a circularity of 0.90 or more, and an amorphous proportion of 90% or more.

According to aspects of the present invention, metal powder that has an average particle diameter of less than 50 μm, an amorphous proportion of 90% or more, an apparent density of 3.5 g/cm$^3$ or more, and a circularity of 0.90 or more can be obtained even when the total Fe, Ni, and Co content is 76.0 at % or more.

Furthermore, nanosized crystals deposit when the water-atomized metal powder obtained in accordance with aspects of the present invention is formed and subjected to an appropriate heat treatment.

In particular, water-atomized metal powder having a high iron-group element content can achieve both low loss and high magnetic flux density by performing an appropriate heat treatment after formation of the metal powder.

In addition, recently, nanocrystal materials and heteroamorphous materials exhibiting a high magnetic flux density have been developed as described in Materia Japan vol. 41, No. 6, p. 392; Journal of Applied Physics 105, 013922 (2009); Japanese Patent No. 4288687; Japanese Patent No. 4310480; Japanese Patent No. 4815014; WO 2010/084900; Japanese Unexamined Patent Application Publication No. 2008-231534; Japanese Unexamined Patent Application Publication No. 2008-231533; and Japanese Patent No. 2710938, for example. Aspects of the present invention are highly advantageously suitable for the production of such metal powder having a high iron-group element content by a water atomization process. In particular, when the Fe-group component concentration in at % is 76.0% or more, it has been extremely difficult to increase an amorphous proportion by conventional techniques.

However, it is possible by applying the production method according to aspects of the present invention to obtain metal powder having an average particle diameter of less than 50 μm, an apparent density of 3.5 g/cm$^3$ or more, a circularity ($C_{50}$) of 0.90 or more, and an amorphous proportion of 90% or more.

DETAILED DESCRIPTION OF EMBODIMENTS OF THE INVENTION

Hereinafter, embodiments of the present invention are described. However, the present invention is not limited to the following embodiments.

A production method for water-atomized metal powder according to an embodiment is a method for producing water-atomized metal powder by dividing a molten metal stream, which is falling in a vertical direction, by spraying cooling water that impinges on the molten metal stream, the method including: a step of spraying the cooling water at a spray pressure of 10 MPa or more and a spread angle in a range of 5° to 30° from each of three or more cooling water discharge ports arranged remote from the falling molten metal stream, in which a droplet diameter of the cooling water discharged toward the molten metal stream is 100 μm or less in Sauter mean, a trajectory of the cooling water discharged toward the molten metal stream and a trajectory of the molten metal stream form a convergence angle in a range of 5° to 10°, a water/molten steel ratio (F/M) of an amount F (kg/min) of the cooling water discharged toward the molten metal stream to an amount M (kg/min) of the falling molten metal stream is 50 or more.

The metal powder obtained by this method has a total Fe, Ni, and Co content of 76.0 at % or more and 86.0 at % or less in atomic percent, an average particle diameter of less than 50 μm, an apparent density of 3.5 g/cm$^3$ or more, a circularity of 0.90 or more, and an amorphous proportion of 90% or more.

In the present embodiment, a preferable production apparatus for water-atomized metal powder and a method for producing the water-atomized metal powder are described together.

Figure 1:
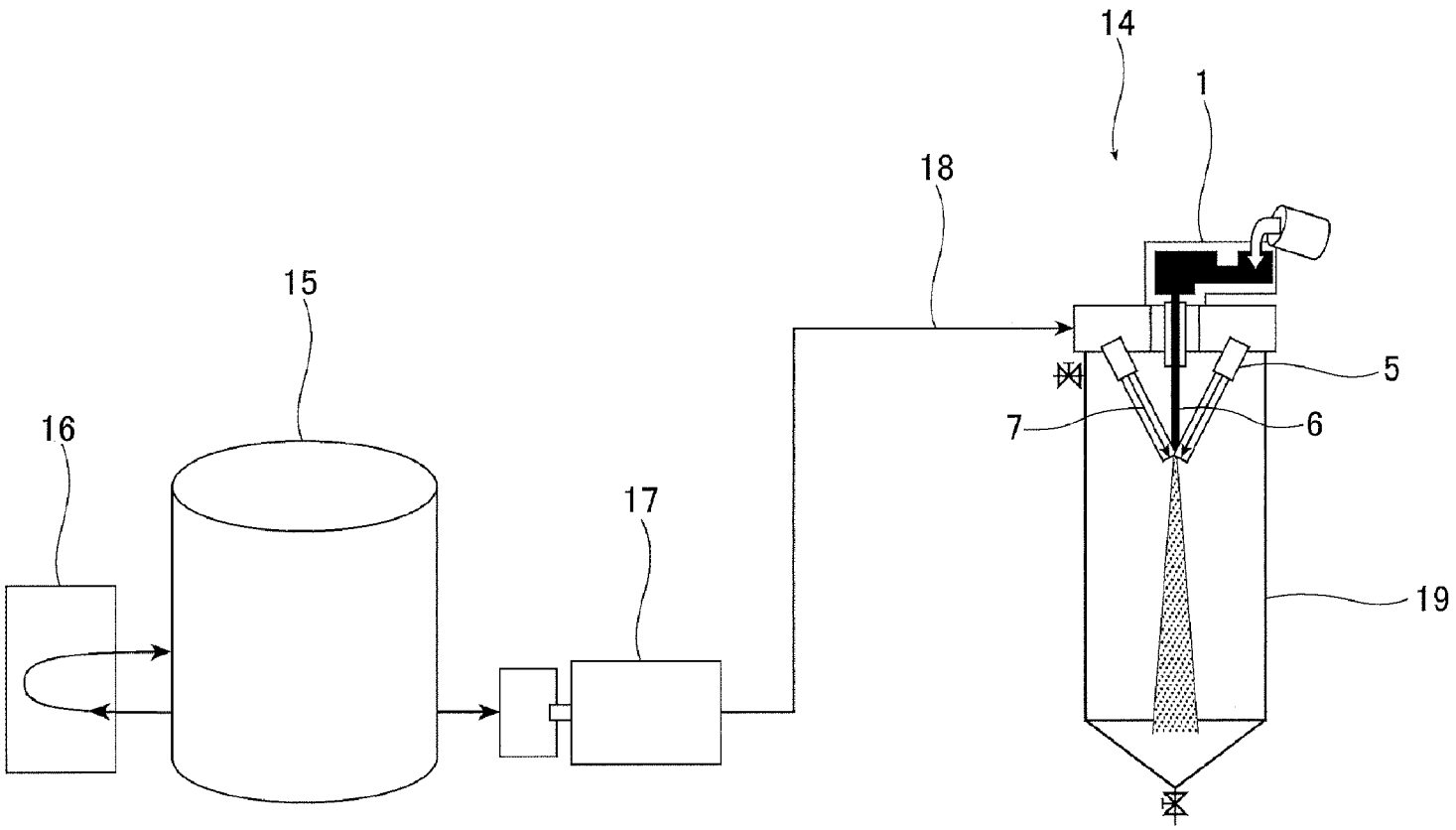
FIG. 1 schematically illustrates a production apparatus for water-atomized metal powder used for the production of a present embodiment.
Figure 2:
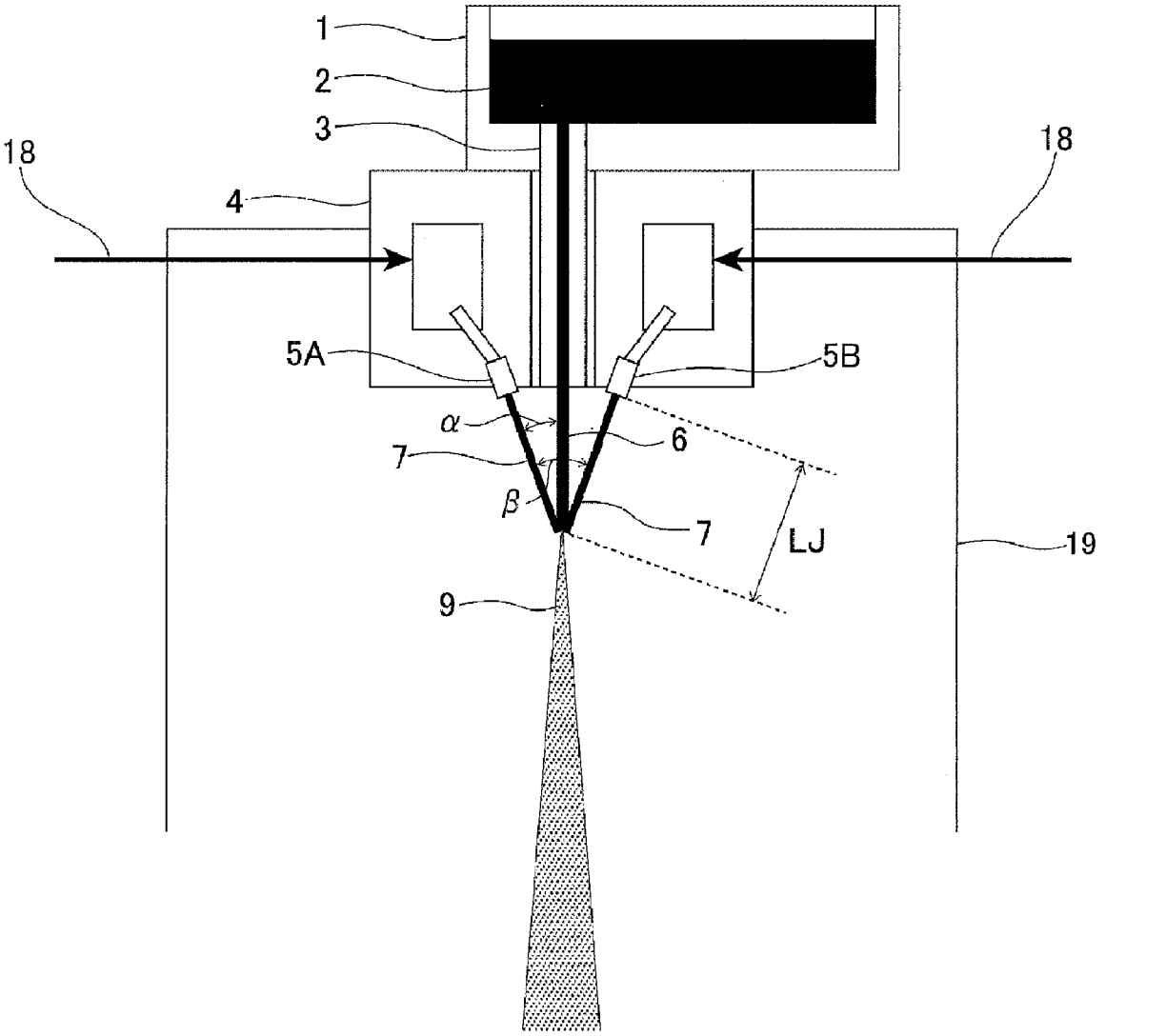
FIG. 2 schematically illustrates an atomizing apparatus used for the production of the present embodiment.
Figure 3:
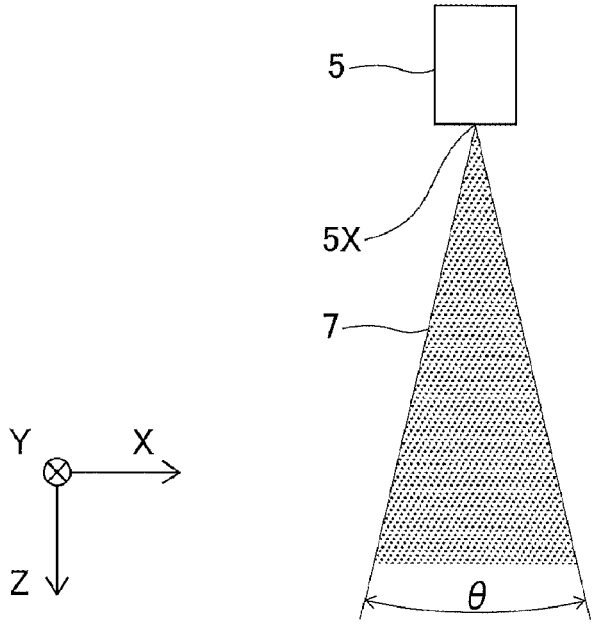
FIG. 3 illustrates the state of a spray from a flat fan spray nozzle.
Figure 4:
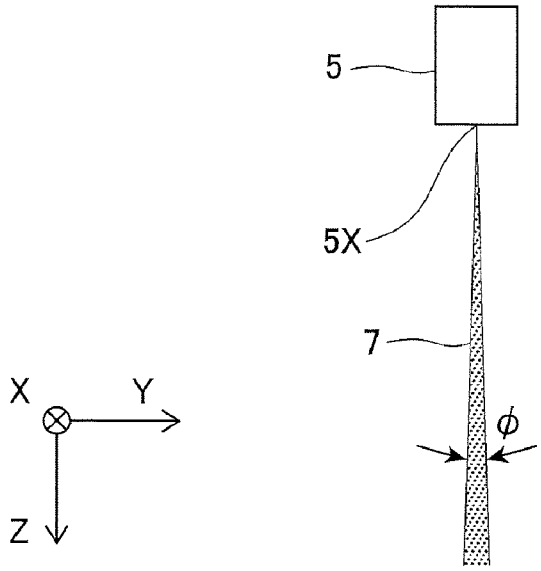
FIG. 4 illustrates the state of a spray from the flat spray nozzle as viewed from side relative to FIG. 3.

FIG. 1 schematically illustrates a production apparatus for water-atomized metal powder used for the production of a present embodiment. FIG. 2 schematically illustrates an atomizing apparatus used for the production of the present embodiment. FIGS. 3 and 4 each illustrate the state of a spray from a flat fan spray nozzle.

The production apparatus for water-atomized metal powder illustrated in FIG. 1 is constituted by an atomizing apparatus 14, a cooling water high-pressure pump 17, and a cooling water tank 15. Regarding the cooling water, the temperature inside the cooling water tank 15 is adjusted by using a cooling water temperature adjuster 16, and the cooling water is fed to the cooling water high-pressure pump 17, and then fed to the atomizing apparatus 14 from the cooling water high-pressure pump 17 through a cooling water pipe (water feed pipe from a high-pressure pump) 18. Furthermore, in the atomizing apparatus 14, cooling water 7 is sprayed from a cooling water nozzle (spray nozzle) 5 toward a molten metal stream 6 falling in the vertical direction so as to divide the molten metal stream 6 into metal powder, and this metal powder is cooled to produce the metal powder. Although one cooling water high-pressure pump 17 is illustrated in the drawing, two or more cooling water high-pressure pumps 17 may be provided for each cooling water.

The atomizing apparatus 14 illustrated in FIG. 2 includes a tundish 1, a molten steel nozzle 3, a nozzle header 4, cooling water nozzles (spray nozzles) 5A and 5B, a water feed pipe 18 from the high-pressure pump, and a chamber 19.

The tundish 1 is a container-like member into which molten steel 2 melted in a melting furnace is poured. A common tundish may be used as the tundish 1. As illustrated in FIG. 1, an opening is formed in the bottom of the tundish 1 for connecting with the molten steel nozzle 3.

The composition of water-atomized metal powder to be produced can be adjusted by adjusting the composition of the molten steel 2. The production method of the present embodiment is suitable for producing atomized metal powder having a total Fe, Ni, and Co content of 76.0 at % or more and 86.0 at % or less in atomic percent and an average particle diameter of less than 50 μm. The atomized metal powder preferably contains at least one selected from Si, P, and B, and preferably further contains Cu. Thus, in order to produce water-atomized metal powder having the aforementioned composition, the composition of the molten steel 2 may be adjusted to be within the aforementioned range.

The molten steel nozzle 3 is a cylindrical body connected to the opening in the bottom of the tundish 1. The molten steel 2 passes through the inside of the molten steel nozzle 3. If the molten steel nozzle 3 has a large length, the temperature of the molten steel 2 decreases while passing therethrough. Thus, the melting temperature in the melting furnace needs to be determined by taking the decrease in temperature in the molten steel nozzle 3 into account. The length of the molten steel nozzle 3 depends on the thickness of the nozzle header 4. For a high spray pressure, the nozzle header needs to be thick to withstand the pressure, and the length of the molten steel nozzle 3 also needs to be altered. The amount of falling molten steel per unit time (amount M (kg/min) of falling molten metal stream) can be adjusted by the spray hole diameter of the molten steel nozzle 3.

The spray nozzles 5A and 5B are suitable for discharging cooling water 7 that will impinge on the molten metal stream 6, and the ratio of the amount F of cooling water 7 discharged from the discharge ports of the spray nozzles 5A and 5B to the amount M of the molten steel is the water/molten steel ratio (F/M). In this embodiment, this water/molten steel ratio (F/M) is adjusted to 50 or more.

At a water/molten steel ratio (F/M) of less than 50, the cooling rate is low, and the powder is likely to crystallize entirely or partly; thus, the desired amorphous proportion may not be obtained. The water/molten steel ratio (F/M) is preferably 80 or more and more preferably 100 or more.

The spray nozzles 5A and 5B allow the cooling water 7 to impinge on the molten metal stream 6 falling in the vertical direction through the inside of the molten steel nozzle 3 by spraying the cooling water 7 toward the molten metal stream 6. As a result, the molten metal stream 6 is divided and metal powder is obtained.

The spray nozzles 5A and 5B are preferably arranged on a circumference at a regular interval (equal angle) to maintain symmetricity of atomization. In this embodiment, cooling water 7 is discharged from each of three or more cooling water discharge ports arranged remote from the falling molten metal stream 6. Three or more spray nozzles 5A and 5B are preferably provided on the lower portion of the nozzle header 4 to match the number of the cooling water discharge ports. The number of spray nozzles 5A and 5B is preferably large in order to reduce density variation (region where the amount of sprayed water is small and region where the amount of sprayed water is large) in the water film formed by the cooling water 7 sprayed from the nozzle, but is preferably 36 or less since there is a limit to the number of nozzles that can be placed on the circumference and that can be installed in the process. The number of spray nozzles 5A and 5B is more preferably 8 or more. The number of spray nozzles 5A and 5B is more preferably 18 or less. The number of spray nozzles 5A and 5B may be an odd number or an even number.

The structure of the spray nozzles 5A and 5B is not particularly limited, but flat spray nozzles are preferably used. As illustrated in FIG. 3, when viewed in the falling direction of the molten metal stream 6, in other words, in a vertical section in the falling direction of the molten metal stream 6, water is sprayed toward the molten metal stream 6 such that droplets from the cooling water discharge port 5X spread in a fan shape toward the molten metal stream 6 (also see FIG. 6 described below).

As illustrated in FIG. 3, the spread angle θ refers to an angle formed between the trajectories of water droplets at the two ends (outermost ends) on the assumption that the cooling water discharge port 5X is the center of the circle of the fan shape.

Figure 5:
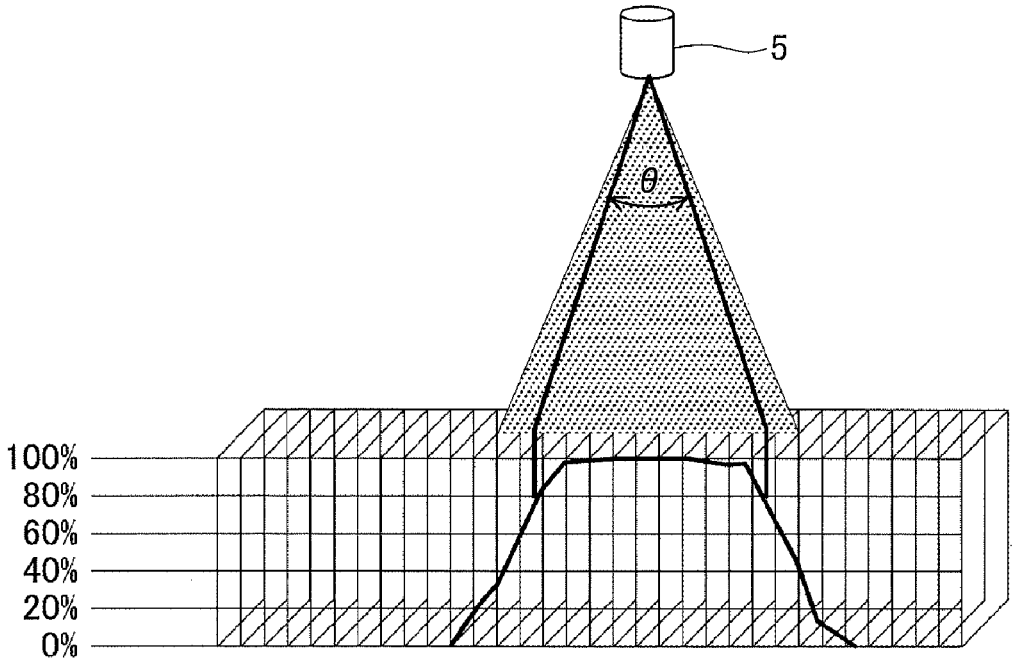
FIG. 5 is a diagram for explaining one example of a method for measuring the spread angle G.

FIG. 5 is a diagram for explaining one example of a specific method for measuring the spread angle θ. As illustrated in FIG. 5, a transparent acrylic grid box having particular dimensions (for example, a height of 300 mm, a length of 150 mm, and a width of 700 mm) and divided at a particular pitch (for example, a 10 mm pitch) is prepared, the spray nozzles 5A and 5B are installed at particular positions from the upper edge of the grid box (for example, at positions 1 m from the upper edge of the transparent acrylic grid box), and the cooling water 7 is sprayed vertically downward such that the sprayed cooling water 7 does not spill out of the grid box. Spraying is stopped the moment the cooling water 7 reaches the upper edge (100%) of the grid box, and the angle formed between the aforementioned circle center and the two end positions of the range where the cooling water 7 fills a particular proportion of the grid cells (this may be set to 80% or more, 75% or more, or 70% or more) may be assumed to be the spread angle δ.

Meanwhile, as illustrated in FIG. 4, when viewed from the side of the plane where the water droplets spread as illustrated in FIG. 3 (this side is a YZ plane orthogonal to an XZ plane along which the water droplets spread, and is also referred to as a section), flat spray nozzles spray water droplets without spreading. Here, in the direction illustrated in FIG. 4, the spread angle φ in the thickness direction (section direction) is preferably 2° or less and more preferably 1.5° or less, and preferably 1° or more.

In contrast, the spread angle θ of the water droplets illustrated in FIG. 3 is 5° to 30°.

When θ is less than 5°, density variation of the cooling water 7 described above is likely to occur. In other words, in the molten metal stream 6, the sparce portion exposed to less sprayed cooling water 7 is likely to generate coarse particles whereas the dense portion exposed to more sprayed cooling water 7 is likely to generate particles with a low apparent density due to a strong cooling effect. Thus, the desired apparent density and circularity may not be obtained. Meanwhile, at θ exceeding 30°, adjacent fan-shaped sprays of cooling water 7 interfere with each other, and thus the cooling energy of the high-pressure spray is lost. Thus, coarse particles are likely to be generated and crystallization easily occurs due to low cooling performance. Therefore, the desired average particle diameter and amorphous proportion may not be obtained. Thus, the spread angle θ of the water droplets is to be 5° to 30°. More preferably, θ is 8° or more and yet more preferably 10° or more. More preferably, θ is 20° or less and yet more preferably 15° or less.

Figure 6:
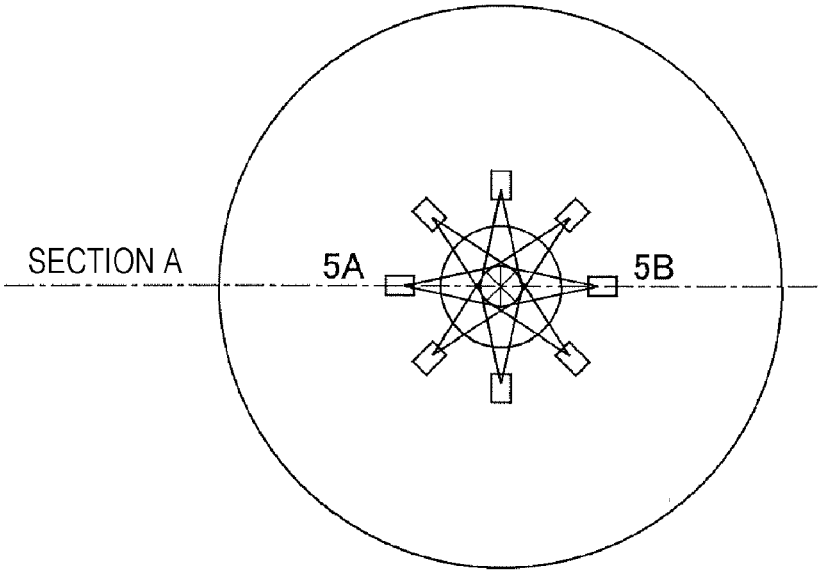
FIG. 6 illustrates the state of a spray from a flat spray nozzle as viewed from the top relative to FIG. 2.

FIG. 6 illustrates the state of sprays from flat spray nozzles as viewed from the top relative to FIG. 2. When multiple flat spray nozzles having the aforementioned structure are used, as illustrated in FIG. 6, the cooling water 7 is sprayed so as to spread toward the center (toward the molten metal stream 6) as viewed from the top of the device 14 in the direction (vertical direction) of the fall of the molten metal stream 6 illustrated in FIG. 2. FIG. 2 is a diagram of the section A in FIG. 6 as viewed in the vertical direction of the section A.

The spray pressure is set to 10 MPa or more. At a spray pressure of less than 10 MPa, the strength is not sufficient for atomizing water, and the obtained atomized metal powder fails to have the desired average particle diameter. In addition, the desired amorphous proportion may not be obtained. Thus, the spray pressure is set to 10 MPa or more. The spray pressure is preferably 12 MPa or more and more preferably 15 MPa or more. The spray pressure is preferably 100 MPa or less and more preferably 50 MPa or less.

As described above, in the production method for water-atomized metal powder according to this embodiment, cooling water is sprayed at a spray pressure of 10 MPa or more and a spread angle in the range of 5° to 30° from each of three or more cooling water discharge ports arranged remote from the falling molten metal stream.

The spray pressure refers to the pressure of water inside the nozzle header 4, is a pressure of the cooling water discharged from the cooling water discharge port 5X, and is preliminarily set by the design of the spray nozzles 5A and 5B.

The distance LJ (see FIG. 2) between the cooling water discharge port 5X of each of the spray nozzles 5A and 5B and the contact position with the molten metal stream 6 is not particularly limited but is preferably 50 mm or more. The distance LJ is preferably 200 mm or less.

When the distance LJ is excessively large, the energy of the sprayed cooling water 7 is lost and the particles tend to be coarse; in contrast, when the distance LJ is excessively small, density variation in the sprayed cooling water 7 is likely to occur. Thus, the distance LJ is preferably 50 mm or more and more preferably 80 mm or more. The distance LJ is preferably 200 mm or less and more preferably 150 mm or less.

The droplet diameter of the cooling water 7 discharged toward the molten metal stream 6 is 100 μm or less in Sauter mean ($D_{32}$). When the droplet diameter in Sauter mean is more than 100 μm, the amount of the molten metal stream 6 that comes into contact with the droplets during division of the molten metal stream 6 increases, and thus the desired average particle diameter is not obtained.

As the average particle diameter increases, the amount of cooling water needed per one particle of the powder increases, and amorphization may become difficult. Thus, the droplet diameter in Sauter mean is to be 100 μm or less. In addition, the droplet diameter is preferably 80 μm or less and more preferably 50 μm or less.

The droplet diameter is measured off-line by a PDA method, and, if measurement by the PDA method is difficult due to a high spray pressure, the droplet diameter is determined by image analysis by taking an image with a high-speed camera at one million frames/sec or higher.

Moreover, as indicated by sign α in FIG. 2, the convergence angle formed between the trajectory of the molten metal stream and the trajectory of cooling water 7 discharged toward the molten metal stream 6 from each of the three or more cooling water discharge ports 5X arranged remote from the falling molten metal stream 6 is adjusted to be 5 to 10°. Here, the trajectory refers to a straight-line trajectory formed by connecting the center position of a region where the cooling water 7 contacts the molten metal stream 6 to the cooling water discharge port 5X.

When α is less than 5°, the energy of dividing the molten metal stream 6 decreases, and thus the desired amorphous proportion may not be obtained. In contrast, when α exceeds 10°, the impact force that divides the molten metal stream 6 is strong, and the cooling effect is intensified; thus, the desired circularity may not be obtained. Thus, the convergence angle α is to be 5° to 10°. Preferably, the convergence angle α is 7.5° or more. In FIG. 2, two cooling discharge ports 5X face each other and a pair of sprays of the cooling water 7 are discharged toward the molten metal stream. In FIG. 2, β denotes the angle (installation angle) formed between the trajectory of one of the sprays of the cooling water 7 and the trajectory of the other spray of the cooling water 7, and since α is 5° to 10°, β is 10° to 20°.

The chamber 19 forms a space for producing metal powder under the nozzle header 4. The metal powder produced by water atomization is stored in the chamber 19 along with water, dehydrated, and dried at a temperature of 200° C. or lower to obtain metal powder free of water.

Next, the average particle diameter, apparent density, circularity, and amorphous proportion of the obtained metal powder are measured.

The apparent density is measured in accordance with JIS Z 2504:2012.

The circularity is measured by using Morphologi Particle Image Analyzer (G3SE) by acquiring projection images of about 5000 powder particles dispersed over a mount and binarizing the particle data of the projection images to determine the volume-average value ($C_{50}$) through the image analysis.

The amorphous proportion is calculated by removing foreign matters other than the metal powder from the obtained metal powder, measuring the halo peaks from the amorphous phases and the diffraction peaks from the crystals by X-ray diffractometry, and calculating the amorphous proportion by a WPPD method. Here, the "WPPD method" stands for the whole-powder-pattern decomposition method, and the detailed description therefor is provided in Hideo TORAYA, Journal of the Crystallographic Society of Japan, vol. 30 (1988), No. 4, pp. 253 to 258.

The particle diameter is calculated as the average particle diameter ($D_{50}$) by a cumulative method. In addition, laser diffraction/scattering-type particle size distribution measurement can be employed.

The metal powder obtained as such has a total Fe, Ni, and Co content of 76.0 at % or more and 86.0 at % or less in atomic percent, an average particle diameter of less than 50 μm, an apparent density of 3.5 g/cm$^3$ or more, a circularity of 0.90 or more, and an amorphous proportion of 90% or more.

EXAMPLES

Examples and Comparative Examples were carried out using equipment similar to the production equipment illustrated in FIGS. 1 and 2.

In the atomizing apparatus, 12, 4, or 2 spray nozzles were arranged on a circumference at regular intervals on a plane perpendicular to the direction of the fall of the molten metal stream, and the convergence angle α formed between the trajectory of the cooling water discharged toward the molten metal stream and the trajectory of the molten metal stream was set to 2.5° to 15°. In other words, the spray nozzles were placed on a circumference on a plane perpendicular to the direction of the fall of the molten metal stream, and the installation angle β of the two spray nozzles facing each other was set to 5° to 30°. Here, facing means that the spray nozzles are placed within the range of 180°±10° with respect to the center axis coincident with the direction of the fall of the molten metal stream. In addition, the spread angle θ of the flat spray nozzle illustrated in FIGS. 3 and 4 used in Examples was set to 3° to 40°. The amount F of cooling water was adjusted to be within 120 to 500 kg/min, and the spray pressure was set to be in the range of 5 to 30 MPa. The spray nozzles were altered so that the intended amount of water and spray pressure were achieved.

To carry out the production methods of Examples and Comparative Examples, soft magnetic materials having the following compositions were prepared. Here, "%" means "at %." (i) to (v) are Fe-based soft magnetic materials, (vi) is a (Fe+Co)-based soft magnetic material, and (vii) is a (Fe+Co+Ni)-based soft magnetic material.

(i) Fe 76.0%-Si 9.0%-B 10.0%-P 5.0%

(ii) Fe 78.0%-Si 9.0%-B 9.0%-P 4.0%

(iii) Fe 80.0%-Si 8.0%-B 8.0%-P 4.0%

(iv) Fe 82.8%-B 11.0%-P 5.0%-Cu 1.2%

(v) Fe 84.8%-Si 4.0%-B 10.0%-Cu 1.2%

(vi) Fe 69.8%-Co 15.0%-B 10.0%-P 4.0%-Cu 1.2%

(vii) Fe 69.8%-Ni 1.2%-Co 15.0%-B 9.4%-P 3.4%-Cu 1.2%

Tables 1 and 2 indicate the raw material conditions, atomization conditions, and powder evaluation of Examples and Comparative Examples.

TABLE 1

| | Raw material conditions | | Atomization conditions | | | | |
|---|---|---|---|---|---|---|---|
| No. | Composition (at %) | Fe + Ni + Co (at %) | Amount M of falling molten steel (kg/min) | Convergence angle α (°) | Type and number of nozzles | Spray pressure (MPa) | Water droplet (droplet) Sauter mean diameter [$D_{32}$] (μm) |
| Example 1 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | 30° fan spray × 12 | 30 | 54 |
| Example 2 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | 15° fan spray × 12 | 30 | 52 |
| Example 3 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | 5° fan spray × 12 | 30 | 47 |
| Example 4 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 5.0 | 15° fan spray × 12 | 30 | 52 |
| Example 5 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 7.5 | 15° fan spray × 12 | 30 | 52 |
| Example 6 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | 15° fan spray × 4 | 30 | 64 |
| Example 7 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | 15° fan spray × 12 | 15 | 89 |
| Example 8 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2 | 76.0<br>78.0<br>80.0<br>82.8<br>84.8 | 4 to 5 | 10 | 15° fan spray × 12 | 30 | 55 |

TABLE 1-continued

| | | | | | | | |
|---|---|---|---|---|---|---|---|
| | (vi) Fe69.8Co15.0B10.0P4.0Cu1.2 | 84.8 | | | | | |
| | (vii) Fe69.8Ni1.2Co15.0B9.4P3.4Cu1.2 | 86.0 | | | | | |
| Example 9 | (i) Fe76.0Si9.0B10.0P5.0 | 76.0 | 4 to 5 | 10 | 15° fan spray × 12 | 30 | 58 |
| | (ii) Fe78.0Si9.0B9.0P4.0 | 78.0 | | | | | |
| | (iii) Fe80.0Si8.0B8.0P4.0 | 80.0 | | | | | |
| | (iv) Fe82.8B11.0P5.0Cu1.2 | 82.8 | | | | | |
| | (v) Fe84.8Si4.0B10.0Cu1.2 | 84.8 | | | | | |
| | (vi) Fe69.8Co15.0B10.0P4.0Cu1.2 | 84.8 | | | | | |
| | (vii) Fe69.8Ni1.2Co15.0B9.4P3.4Cu1.2 | 86.0 | | | | | |

| | Atomization conditions | | Powder evaluation | | | | |
|---|---|---|---|---|---|---|---|
| | Amount | | | | | | |
| No. | F of sprayed cooling water (kg/min) | Water/molten steel ratio F/M (—) | Average particle diameter [$D_{50}$] (μm) | Apparent density (g/cm$^3$) | Circularity [$C_{50}$] (—) | Amorphous proportion (%) | Pass or fail |
| Example 1 | 250 | 50 to 62.5 | 35.4 | 4.24 | 0.99 | 100 | ○ |
| | | | 34.4 | 4.22 | 0.99 | 100 | ○ |
| | | | 34.8 | 4.24 | 0.99 | 100 | ○ |
| | | | 33.6 | 4.21 | 0.99 | 98 | ○ |
| | | | 33.3 | 4.23 | 0.99 | 97 | ○ |
| | | | 33.5 | 4.19 | 0.98 | 94 | ○ |
| | | | 31.4 | 4.15 | 0.97 | 92 | ○ |
| Example 2 | 250 | 50 to 62.5 | 32.9 | 4.11 | 0.97 | 100 | ○ |
| | | | 32.7 | 4.12 | 0.98 | 100 | ○ |
| | | | 32.2 | 4.03 | 0.97 | 100 | ○ |
| | | | 32.6 | 3.97 | 0.96 | 99 | ○ |
| | | | 32.5 | 3.98 | 0.96 | 99 | ○ |
| | | | 30.2 | 3.91 | 0.96 | 97 | ○ |
| | | | 29.8 | 3.88 | 0.96 | 93 | ○ |
| Example 3 | 250 | 50 to 62.5 | 28.4 | 3.98 | 0.96 | 100 | ○ |
| | | | 28.3 | 3.97 | 0.97 | 100 | ○ |
| | | | 28.5 | 3.91 | 0.97 | 100 | ○ |
| | | | 27.6 | 3.87 | 0.96 | 100 | ○ |
| | | | 27.5 | 3.89 | 0.95 | 98 | ○ |
| | | | 27.0 | 3.88 | 0.95 | 98 | ○ |
| | | | 27.3 | 3.72 | 0.95 | 94 | ○ |
| Example 4 | 250 | 50 to 62.5 | 37.2 | 4.29 | 0.99 | 100 | ○ |
| | | | 37.3 | 4.24 | 0.99 | 100 | ○ |
| | | | 36.9 | 4.25 | 0.99 | 99 | ○ |
| | | | 37.1 | 4.22 | 0.99 | 97 | ○ |
| | | | 37.1 | 4.24 | 0.99 | 94 | ○ |
| | | | 36.2 | 4.21 | 0.99 | 93 | ○ |
| | | | 35.5 | 4.18 | 0.98 | 91 | ○ |
| Example 5 | 250 | 50 to 62.5 | 35.3 | 4.31 | 0.99 | 100 | ○ |
| | | | 35.0 | 4.25 | 0.99 | 100 | ○ |
| | | | 34.9 | 4.24 | 0.99 | 100 | ○ |
| | | | 33.7 | 4.25 | 0.99 | 97 | ○ |
| | | | 33.6 | 4.21 | 0.99 | 95 | ○ |
| | | | 33.2 | 4.21 | 0.99 | 94 | ○ |
| | | | 31.8 | 4.20 | 0.99 | 91 | ○ |
| Example 6 | 250 | 50 to 62.5 | 35.8 | 3.98 | 0.97 | 100 | ○ |
| | | | 34.9 | 4.01 | 0.98 | 100 | ○ |
| | | | 34.0 | 3.89 | 0.97 | 98 | ○ |
| | | | 34.2 | 3.88 | 0.96 | 98 | ○ |
| | | | 33.9 | 3.85 | 0.96 | 96 | ○ |
| | | | 33.7 | 3.84 | 0.96 | 93 | ○ |
| | | | 33.0 | 3.72 | 0.95 | 92 | ○ |
| Example 7 | 250 | 50 to 62.5 | 46.5 | 4.12 | 0.98 | 99 | ○ |
| | | | 45.5 | 4.13 | 0.99 | 99 | ○ |
| | | | 45.8 | 4.12 | 0.99 | 98 | ○ |
| | | | 45.3 | 4.13 | 0.99 | 97 | ○ |
| | | | 45.5 | 4.04 | 0.97 | 96 | ○ |
| | | | 44.5 | 3.89 | 0.95 | 92 | ○ |
| | | | 43.9 | 3.90 | 0.96 | 90 | ○ |
| Example 8 | 400 | 80-100 | 37.2 | 3.97 | 0.97 | 100 | ○ |
| | | | 36.3 | 3.99 | 0.98 | 100 | ○ |
| | | | 34.5 | 3.89 | 0.96 | 100 | ○ |
| | | | 35.2 | 3.88 | 0.96 | 100 | ○ |
| | | | 33.9 | 3.87 | 0.95 | 98 | ○ |
| | | | 33.8 | 3.82 | 0.95 | 97 | ○ |
| | | | 33.1 | 3.71 | 0.95 | 95 | ○ |

TABLE 1-continued

| | | | | | | | |
|---|---|---|---|---|---|---|---|
| Example 9 | 500 | 100-125 | 38.8 | 3.92 | 0.96 | 100 | ○ |
| | | | 37.8 | 3.92 | 0.97 | 100 | ○ |
| | | | 37.1 | 3.88 | 0.96 | 100 | ○ |
| | | | 36.3 | 3.85 | 0.95 | 100 | ○ |
| | | | 36.2 | 3.82 | 0.95 | 100 | ○ |
| | | | 35.0 | 3.81 | 0.94 | 100 | ○ |
| | | | 34.1 | 3.70 | 0.92 | 98 | ○ |

TABLE 2

| | Raw material conditions | | Atomization conditions | | | |
|---|---|---|---|---|---|---|
| No. | Composition (at %) | Fe + Ni + Co (at %) | Amount M of falling molten steel (kg/min) | Convergence angle α (°) | Type and number of nozzles | Spray pressure (MPa) |
| Comparative Example 1 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | Solid (line) nozzle × 12 | 15 |
| Comparative Example 2 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | 3° fan spray × 12 | 30 |
| Comparative Example 3 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | 40° fan spray × 12 | 30 |
| Comparative Example 4 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | 15° fan spray × 12 | 5 |
| Comparative Example 5 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 2.5 | 15° fan spray × 12 | 30 |
| Comparative Example 6 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 15 | 15° fan spray × 12 | 30 |
| Comparative Example 7 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15B9.4P3.4Cu1.2 | 76.0<br>78.0<br>80.0<br>82.8<br>84.8<br>84.8<br>86.0 | 4 to 5 | 10 | 15° fan spray × 12 | 30 |

TABLE 2-continued

| | | | | | | |
|---|---|---|---|---|---|---|
| Comparative Example 8 | (i) Fe76.0Si9.0B10.0P5.0<br>(ii) Fe78.0Si9.0B9.0P4.0<br>(iii) Fe80.0Si8.0B8.0P4.0<br>(iv) Fe82.8B11.0P5.0Cu1.2<br>(v) Fe84.8Si4.0B10.0Cu1.2<br>(vi) Fe69.8Co15.0B10.0P4.0Cu1.2<br>(vii) Fe69.8Ni1.2Co15.0B9.4P3.4Cu1.2 | 76.0<br>78.0<br>80.0<br>82.8<br>84.8<br>84.8<br>86.0 | 4 to 5 | 10 | 15° fan spray × 12 | 30 |

| | Atomization conditions | | | Powder evaluation | | | | |
|---|---|---|---|---|---|---|---|---|
| | Water droplet (droplet) | Amount | | | | | | |
| No. | Sauter mean diameter [$D_{32}$] (μm) | F of sprayed cooling water (kg/min) | Water/molten steel ratio F/M (—) | Average particle diameter [$D_{50}$] (μm) | Apparent density (g/cm$^3$) | Circularity [$C_{50}$] (—) | Amorphous proportion (%) | Pass or fail |
| Comparative Example 1 | 89 | 250 | 50 to 62.5 | 27.3 | 2.83 | 0.79 | 100 | x |
| | | | | 26.5 | 2.92 | 0.83 | 100 | x |
| | | | | 25.3 | 2.95 | 0.84 | 100 | x |
| | | | | 26.2 | 2.81 | 0.80 | 100 | x |
| | | | | 25.9 | 2.88 | 0.82 | 98 | x |
| | | | | 25.8 | 2.73 | 0.75 | 96 | x |
| | | | | 24.3 | 2.43 | 0.72 | 95 | x |
| Comparative Example 2 | 47 | 250 | 50 to 62.5 | 27.8 | 3.35 | 0.87 | 100 | x |
| | | | | 27.5 | 3.41 | 0.88 | 100 | x |
| | | | | 27.9 | 3.38 | 0.87 | 100 | x |
| | | | | 25.9 | 3.37 | 0.86 | 99 | x |
| | | | | 26.3 | 3.21 | 0.85 | 97 | x |
| | | | | 26.6 | 3.29 | 0.85 | 97 | x |
| | | | | 25.8 | 3.12 | 0.84 | 93 | x |
| Comparative Example 3 | 54 | 250 | 50 to 62.5 | 55.3 | 3.98 | 0.97 | 87 | x |
| | | | | 55.4 | 3.82 | 0.95 | 88 | x |
| | | | | 55.1 | 3.78 | 0.95 | 84 | x |
| | | | | 54.2 | 3.92 | 0.97 | 83 | x |
| | | | | 54.8 | 3.82 | 0.96 | 78 | x |
| | | | | 54.3 | 3.78 | 0.96 | 74 | x |
| | | | | 53.2 | 3.82 | 0.96 | 47 | x |
| Comparative Example 4 | 126 | 250 | 50 to 62.5 | 72.3 | 3.92 | 0.97 | 89 | x |
| | | | | 71.6 | 3.85 | 0.96 | 87 | x |
| | | | | 70.3 | 3.98 | 0.98 | 83 | x |
| | | | | 72.9 | 4.02 | 0.98 | 81 | x |
| | | | | 68.3 | 3.98 | 0.98 | 73 | x |
| | | | | 65.5 | 3.81 | 0.96 | 71 | x |
| | | | | 67.1 | 3.82 | 0.96 | 43 | x |
| Comparative Example 5 | 52 | 250 | 50 to 62.5 | 48.8 | 3.99 | 0.98 | 87 | x |
| | | | | 47.5 | 3.87 | 0.97 | 82 | x |
| | | | | 44.5 | 3.92 | 0.97 | 81 | x |
| | | | | 46.9 | 3.93 | 0.97 | 77 | x |
| | | | | 44.1 | 3.95 | 0.98 | 75 | x |
| | | | | 48.2 | 3.91 | 0.97 | 74 | x |
| | | | | 45.3 | 3.88 | 0.96 | 79 | x |
| Comparative Example 6 | 52 | 250 | 50 to 62.5 | 30.2 | 3.12 | 0.85 | 100 | x |
| | | | | 28.3 | 3.25 | 0.86 | 100 | x |
| | | | | 27.9 | 3.29 | 0.87 | 98 | x |
| | | | | 28.5 | 3.18 | 0.85 | 98 | x |
| | | | | 28.2 | 3.19 | 0.86 | 97 | x |
| | | | | 27.3 | 3.13 | 0.86 | 92 | x |
| | | | | 27.9 | 2.92 | 0.82 | 90 | x |
| Comparative Example 7 | 52 | 120 | 24 to 30 | 45.3 | 3.92 | 0.97 | 87 | x |
| | | | | 42.9 | 3.89 | 0.96 | 88 | x |
| | | | | 43.2 | 3.85 | 0.96 | 86 | x |
| | | | | 44.9 | 3.86 | 0.96 | 85 | x |
| | | | | 44.7 | 3.88 | 0.96 | 83 | x |
| | | | | 44.7 | 3.82 | 0.95 | 83 | x |
| | | | | 44.2 | 3.78 | 0.92 | 78 | x |
| Comparative Example 8 | 52 | 250 | 50 to 62.5 | 55.3 | 3.54 | 0.92 | 88 | x |
| | | | | 55.1 | 3.42 | 0.91 | 83 | x |
| | | | | 56.1 | 3.32 | 0.92 | 82 | x |
| | | | | 76.1 | 3.51 | 0.92 | 80 | x |
| | | | | 55.2 | 3.48 | 0.91 | 82 | x |
| | | | | 54.3 | 3.32 | 0.89 | 78 | x |
| | | | | 55.4 | 3.22 | 0.88 | 74 | x |

In Examples and Comparative Examples, raw materials such as iron were placed in a high-frequency melting furnace for each of the components (i) to (vii) and melted under application of high frequencies. The melting temperature before atomization was in the range of 1500° C. to 1650° C. Since the melting point becomes higher with the iron component content, the melting temperature is also high. After the target melting temperature was reached, the high-frequency melting furnace was tilted to pour molten steel into the tundish. A molten steel nozzle of a particular hole diameter was installed at the bottom of the tundish, and the amount of the falling molten steel was adjusted to be within the range of 4 to 5 kg/min. The hole at the tip of the molten metal nozzle from which molten steel was to be dropped was adjusted to φ1.5-2.5 mm. For the atomization conditions, the convergence angle, the type and number of nozzles, the spray pressure, and the amount of cooling water were adjusted as indicated in Table 1. Here, 30° fan spray refers to a nozzle type and indicates that a flat spray nozzle having a spread angle θ of 30° was used.

The Sauter mean diameter of the droplets sprayed from the spray nozzle (hereinafter referred to as the Sauter mean diameter ($D_{32}$)) was separately measured off-line by a PDA method. Since measurement by the PDA method was difficult due to a high spray pressure, the droplet diameter was determined by image analysis by imaging with a high-speed camera at one million frames/sec or higher.

In evaluating the powder, the circularity ($C_{50}$), the average particle diameter ($D_{50}$), the apparent density, and the amorphous proportion were measured by the following methods.

The apparent density was measured in accordance with JIS Z 2504:2012.

The circularity was measured by using Morphologi Particle Image Analyzer (G3SE) by acquiring projection images of about 5000 powder particles dispersed over a mount and binarizing the particle data of the projection images to determine the volume-average value ($C_{50}$) through the image analysis.

The amorphous proportion was calculated by removing foreign matters other than the metal powder from the obtained metal powder, measuring the halo peaks from the amorphous phases and the diffraction peaks from the crystals by X-ray diffractometry, and calculating the amorphous proportion by the WPPD method.

The particle diameter was calculated as the average particle diameter ($D_{50}$) by a cumulative method. A laser diffraction/scattering-type particle size distribution measurement was employed.

The target value of the average particle diameter ($D_{50}$) was set to less than 50 μm, the target values of the apparent density, the circularity ($C_{50}$), and the amorphous proportion were respectively set to 3.5 g/cm$^3$ or more, 0.90 or more, and 90% or more. Powder that attained the target values of all of the apparent density, circularity, average particle diameter, and amorphous proportion was rated pass (○), and powder that did not attain the target value of any one of the apparent density, circularity, average particle diameter, and amorphous proportion was rated fail (x).

The spread angle of the flat fan spray nozzle was 30° in Example 1, 15° in Example 2, and 5° in Example 3. The powders in Examples 1 to 3 performed under the atomization conditions within the range according to aspects of the present invention were all rated pass. Here, the average particle diameter tended to be smaller with a flat fan spray nozzle having a spread angle of 5° than with that having a spread angle of 30°.

In Example 4, atomization conditions within the range according to aspects of the present invention were used with a spray nozzle convergence angle of 5.0° (installation angle: 10°), and although the particle diameter is large, the apparent density is high compared to Example 2.

In Example 5, atomization conditions within the range according to aspects of the present invention were used with a spray nozzle convergence angle of 7.5° (installation angle: 15°), and the average particle diameter could be decreased compared to Example 4.

In Example 6, atomization conditions within the range according to aspects of the present invention were used with four spray nozzles, and the average particle diameter was large and the apparent density was small compared to Example 2 in which 12 spray nozzles were used.

In Example 7, atomization conditions within the range according to aspects of the present invention were used in which the Sauter mean droplet diameter (hereinafter referred to as the Sauter mean diameter ($D_{32}$)) was adjusted to 89 μm by decreasing the spray pressure, and the average particle diameter was large compared to Example 2.

In Example 8, the amount F of cooling water was adjusted to 400 kg/min under conditions of Example 4. The water/molten steel ratio (F/M) was 80 to 100 [-], and was a preferable water/molten steel ratio. In Example 8, atomization conditions within the range according to aspects of the present invention were used, and the amorphous proportion improved in a composition with a high Fe concentration compared to Example 4.

In Example 9, the amount F of cooling water was adjusted to 500 kg/min under conditions of Example 4. The water/molten steel ratio (F/M) was 100 to 125 [-], and was a more preferable water/molten steel ratio. In Example 9, atomization conditions within the range according to aspects of the present invention were used, and the amorphous proportion further improved in a composition with a high Fe concentration compared to Example 4.

Under all conditions in Examples 1 to 9, the powder was rated pass.

In Comparative Example 1, a solid spray nozzle that generated a straight-line water spray was used as the atomizing water spray nozzle, the spread angle was less than 5°, and the nozzle used was outside the range of the present invention.

In Comparative Example 2, a flat fan spray nozzle with a spread angle of 3° was used, and the nozzle used was outside the range of the present invention.

Although the average particle diameter was small in Comparative Examples 1 and 2, the apparent density did not achieve the target value and thus the powder was rated fail. The circularity was also rated fail.

In Comparative Example 3, a flat fan spray nozzle with a spread angle of 40° was used, and the nozzle used was outside the range of the present invention. In this comparative example, the amorphous proportion did not achieve the target value, and thus the powder was rated fail. The average particle diameter was also rated fail.

In Comparative Example 4, the spray pressure was 5 MPa, the Sauter mean diameter ($D_{32}$) was 126 μm, and the conditions were outside the range of the present invention. The average particle diameter and the amorphous proportion did not reach the target values and were rated fail.

In Comparative Examples 5 and 6, the convergence angle of the spray nozzle was 2.5° and 15°, respectively, and the conditions were outside the range of the present invention in both comparative examples. Comparative Example 5 did not reach the target amorphous proportion and Comparative Example 6 did not reach the target apparent density and circularity; thus, both were rated fail.

In Comparative Example 7, the water/molten steel ratio was 24 to 30 [-], and the conditions were outside the range of the present invention. The amorphous proportion did not reach the target value and was rated fail.

In Comparative Example 8, two spray nozzles were used, and the conditions were outside the range of the present invention. The average particle diameter and the amorphous proportion did not reach the target values and were rated fail. In addition, the apparent density and circularity did not reach the target values in some cases.

As described above, metal powders produced in Examples 1 to 9 in the range according to aspects of the present invention were all rated pass, and the metal powders in Comparative Examples 1 to 8 outside the range of the present invention were all rated fail.

REFERENCE SIGNS LIST

1 Tundish
2 Molten steel
3 Molten steel nozzle
4 Nozzle header
5, 5A, 5B Cooling water nozzle (spray nozzle)
5X Cooling water discharge port
6 Molten metal stream
7 Cooling water
9 Metal powder
14 Atomizing apparatus
15 Cooling water tank
16 Cooling water temperature adjuster
17 Cooling water high-pressure pump
18 Cooling water pipe (water feed pipe from high-pressure pump)
19 Chamber
α Convergence angle (contact angle between molten steel vertically falling and sprayed cooling water)
β Installation angle (apex)
θ Spread angle

The invention claimed is:

1. A method for producing water-atomized metal powder by dividing a molten metal stream, which is falling in a vertical direction, by spraying cooling water that impinges on the molten metal stream, the method comprising:

a step of spraying the cooling water at a spray pressure of 10 MPa or more and a spread angle in a range of 5° to 30° from each of three or more cooling water discharge ports arranged remote from the falling molten metal stream, wherein a droplet diameter of the cooling water discharged toward the molten metal stream is 100 μm or less in Sauter mean, a trajectory of the cooling water discharged toward the molten metal stream and a trajectory of the molten metal stream form a convergence angle in a range of 5° to 10°, a water/molten metal ratio (F/M) of an amount F (kg/min) of the cooling water discharged toward the molten metal stream to an amount M (kg/min) of the falling molten metal stream is 50 or more, and the metal powder has a total Fe, Ni, and Co content of 76.0 at % or more and 86.0 at % or less in atomic percent, and an average particle diameter of less than 50 μm, an apparent density of 3.5 g/cm$^3$ or more, a circularity of 0.90 or more, and an amorphous proportion of 90% or more.

* * * * *